US010888745B2

(12) United States Patent
Boggs

(10) Patent No.: US 10,888,745 B2
(45) **Date of Patent: *Jan. 12, 2021**

(54) GOLF CLUB WITH POLYMERIC INSERT AND REMOVABLE WEIGHT

(71) Applicant: Karsten Manufacturing Corporaton, Phoenix, AZ (US)

(72) Inventor: Joshua Boggs, Aledo, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/595,335

(22) Filed: Oct. 7, 2019

(65) Prior Publication Data

US 2020/0030669 A1 Jan. 30, 2020

Related U.S. Application Data

(63) Continuation of application No. 15/425,476, filed on Feb. 6, 2017, now Pat. No. 10,434,378, which is a continuation of application No. 14/493,405, filed on Sep. 23, 2014, now Pat. No. 9,561,406.

(60) Provisional application No. 62/015,092, filed on Sep. 23, 2014.

(51) Int. Cl.

| | |
|---|---|
| ***A63B 53/04*** | (2015.01) |
| ***A63B 53/06*** | (2015.01) |
| *A63B 71/06* | (2006.01) |
| *A63B 60/54* | (2015.01) |

(52) U.S. Cl.

CPC ..... *A63B 53/04* (2013.01); *A63B 53/0466* (2013.01); *A63B 53/06* (2013.01); *A63B 53/0408* (2020.08); *A63B 53/0412* (2020.08); *A63B 53/0433* (2020.08); *A63B 60/54* (2015.10); *A63B 2053/0491* (2013.01); *A63B 2071/0694* (2013.01); *A63B 2209/00* (2013.01); *A63B 2209/02* (2013.01)

(58) Field of Classification Search

CPC . A63B 53/06; A63B 60/54; A63B 2053/0408; A63B 2053/0412; A63B 2053/0433; A63B 205/0491; A63B 2017/0694; A63B 2209/02; B29C 65/782; B29C 65/7823; B29C 65/7829

USPC ..... 473/336

See application file for complete search history.

(56) References Cited

U.S. PATENT DOCUMENTS

| | | | | |
|---|---|---|---|---|
| 1,133,129 A * | 3/1915 | Govan | ..... | A63B 53/0466 473/337 |
| 1,840,924 A * | 1/1932 | Tucker | ..... | A63B 53/02 473/337 |
| 2,750,194 A * | 6/1956 | Clark | ..... | A63B 53/08 473/337 |
| 3,606,327 A * | 9/1971 | Gorman | ..... | A63B 53/04 473/297 |

(Continued)

*Primary Examiner* — William M Pierce

(57) ABSTRACT

A golf club head includes a face, a crown, a sole, and defines a bore that is configured to receive and to selectively retain an elongate weight. The bore is aligned on a longitudinal axis that intersects the face. An elongate weight is insertable into the bore. The elongate weight is rotatable between a first angular position and a second angular position. The golf club head can futher include a compliant stop positioned to contact a protrusion of the elongate weight, such that a torque threshold must be overcome to rotate the elongate weight.

20 Claims, 7 Drawing Sheets

(56) References Cited

U.S. PATENT DOCUMENTS 5,214,307 A * 5/1993 Davis ..... H01L 23/49503 257/666
5,873,791 A * 2/1999 Allen ..... A63B 53/04 473/309
5,888,148 A * 3/1999 Allen ..... A63B 53/04 473/290
6,086,485 A * 7/2000 Hamada ..... A63B 53/04 473/329
6,193,614 B1 * 2/2001 Sasamoto ..... A63B 60/00 473/329
6,354,961 B1 * 3/2002 Allen ..... A63B 60/54 473/329
6,440,010 B1 * 8/2002 Deshmukh ..... A63B 53/047 473/335
6,478,690 B2 11/2002 Helmstetter et al.
6,648,772 B2 11/2003 Vincent et al.
6,890,267 B2 5/2005 Mahaffey et al.
7,108,609 B2 * 9/2006 Stites ..... A63B 53/06 473/256
7,297,073 B2 * 11/2007 Jung ..... A63B 53/0487 473/340
7,316,622 B1 * 1/2008 Lucas ..... A63B 53/007 473/239
7,354,355 B2 * 4/2008 Tavares ..... A63B 53/04 473/329
7,419,441 B2 * 9/2008 Hoffman ..... A63B 53/0466 473/334
7,621,820 B2 * 11/2009 Clausen ..... A63B 53/02 473/288
7,628,711 B2 * 12/2009 Akinori ..... A63B 53/0466 473/335
7,824,277 B2 * 11/2010 Bennett ..... A63B 53/0466 473/328
7,938,739 B2 * 5/2011 Cole ..... A63B 53/047 473/332
7,988,568 B2 * 8/2011 Stites ..... A63B 53/047 473/334
8,062,151 B2 * 11/2011 Boyd ..... A63B 53/0466 473/334
8,235,843 B1 * 8/2012 Rice ..... A63B 60/00 473/334
8,409,031 B2 1/2013 Stites et al.
8,435,135 B2 * 5/2013 Stites ..... A63B 60/00 473/334
8,591,352 B2 * 11/2013 Hirano ..... A63B 53/0466 473/336
8,657,702 B2 2/2014 Boyd et al.
8,814,722 B2 8/2014 Stites et al.
8,827,831 B2 * 9/2014 Burnett ..... A63B 53/04 473/329
8,900,069 B2 * 12/2014 Beach ..... A63B 53/0466 473/329
8,911,302 B1 * 12/2014 Ivanova ..... A63B 53/0475 473/329
8,944,934 B2 * 2/2015 Yamamoto ..... A63B 53/0466 473/334
8,951,145 B2 2/2015 Bezilla et al.
8,992,339 B2 3/2015 Matsunaga
9,033,821 B2 * 5/2015 Beach ..... A63B 53/06 473/334
9,072,949 B2 7/2015 Stites et al.
9,079,368 B2 7/2015 Tavares et al.
9,211,452 B2 12/2015 Bennett et al.
9,339,701 B2 * 5/2016 Boggs ..... A63B 53/0466
9,833,666 B2 * 12/2017 Boggs ..... A63B 53/0466
9,931,548 B2 * 4/2018 Boggs ..... A63B 60/02
9,950,219 B2 * 4/2018 Larson ..... A63B 60/52
9,975,022 B2 * 5/2018 Boggs ..... A63B 60/02
10,046,211 B2 * 8/2018 Franklin ..... A63B 53/0487
10,065,086 B2 * 9/2018 Seluga ..... A63B 60/02
10,071,290 B2 9/2018 Boyd et al.
2002/0065144 A1 * 5/2002 Helmstetter ..... A63B 53/0487 473/332
2002/0137576 A1 * 9/2002 Dammen ..... A63B 53/04 473/336
2003/0036441 A1 * 2/2003 Vincent ..... A63B 53/0466 473/334
2003/0125129 A1 * 7/2003 Saksun, Sr. ..... A63B 53/02 473/341
2004/0176177 A1 * 9/2004 Mahaffey ..... A63B 53/0466 473/256
2008/0119303 A1 * 5/2008 Bennett ..... A63B 60/00 473/338
2010/0099511 A1 * 4/2010 Stites ..... A63B 60/42 473/291
2010/0331100 A1 * 12/2010 Tavares ..... B29C 70/68 473/334
2012/0034992 A1 * 2/2012 Boyd ..... A63B 53/0466 473/290
2012/0142447 A1 * 6/2012 Boyd ..... A63B 60/00 473/329
2012/0165115 A1 * 6/2012 Matsunaga ..... A63B 53/04 473/336
2013/0040755 A1 * 2/2013 Stites ..... A63B 53/0466 473/334
2013/0130828 A1 * 5/2013 Stites ..... A63B 53/0466 473/335
2014/0018184 A1 * 1/2014 Bezilla ..... A63B 53/0466 473/335

* cited by examiner

GOLF CLUB WITH POLYMERIC INSERT AND REMOVABLE WEIGHT

CROSS REFERENCE TO RELATED APPLICATIONS

This is a continuation of U.S. patent application Ser. No. 15/425,476, filed Feb. 6, 2017, which is a continuation of U.S. patent application Ser. No. 14/493,405, filed Sep. 23, 2014, now U.S. Pat. No. 9,561,406, which claims the benefit of priority from U.S. Provisional Patent Application No. 62/015,092, filed Jun. 20, 2014, which are hereby incorporated by reference in their entirety.

TECHNICAL FIELD

The present invention relates generally to golf clubs and golf club heads, and, in particular, to golf clubs and golf club heads having reconfigurable weight parameters.

BACKGROUND

A golf club is generally formed by affixing a club head to a first end of a flexible shaft, and affixing a grip member to a second end of the shaft. Convention and the USGA Rules of Golf have established certain terminology to describe different portions and angular relationships of a club head. For example, a wood-type club head includes a face or striking face, a crown, a sole, a heel, a toe, a back, and a hosel. These club head portions are most easily described when the club head is positioned in a reference position relative to a ground plane. In the reference position, the lie angle of the club (i.e., the angle formed between the shaft and the ground plane) and the loft angle of the club (i.e., the angle formed between the face and the ground plane) are oriented as specified by the manufacturer.

The sole of the club head is generally disposed on an opposite side of the club head from the crown, and is further disposed on an opposite side of the club head from the shaft. When in the reference position, the sole of the club head is intended to contact the ground plane. For the portion of the club that is to the rear of the face, the crown may be separated from the sole at the point on the club head where the surface tangent of the club head is normal to the ground plane.

The hosel is the portion of the club head that is intended to couple the club head with the shaft. The hosel includes an internal bore that is configured to receive the shaft or a suitable shaft adapter. In a configuration where the shaft is directly inserted into the hosel, the hosel bore may have a center hosel-axis that is substantially coincident with a center longitudinal-axis of the shaft. For club head embodiments including a shaft adapter, the shaft may be received in a suitable shaft adapter bore that has a center adapter-axis, which may be substantially coincident with the shaft axis. The shaft adapter-axis may be offset angularly and/or linearly from the hosel-axis to permit adjustment of club parameters via rotation of the shaft adapter with respect to the club head, as is known by persons skilled in the art.

The heel may be defined as the portion of the club head that is proximate to and including the hosel. Conversely, the toe may be the area of the golf club that is the farthest from the shaft. Finally, the back of the club head may be the portion of the club head that is generally opposite the face.

Two key parameters that affect the performance and forgiveness of a club include the magnitude and location of the club head's center of gravity (COG) and the various moments of inertia (MOI) about the COG. The club's moments of inertia relate to the club's resistance to rotation (particularly during an off-center hit). These are often perceived as the club's measure of "forgiveness." In typical driver designs, high moments of inertia are desired to reduce the club's tendency to push or fade a ball. Achieving a high moment of inertia generally involves placing mass as close to the perimeter of the club as possible (to maximize the moment of inertia about the center of gravity), and as close to the toe as possible (to maximize a separate moment of inertia about the shaft).

While the various moments of inertia affect the forgiveness of a club head, the location of the center of gravity can also affect the trajectory of a shot for a given face loft angle. For example, a center of gravity that is positioned as far rearward (i.e., away from the face) and as low (i.e., close to the sole) as possible typically results in a ball flight that has a higher trajectory than a club head with a center of gravity placed more forward and/or higher.

While a high moment of inertia is obtained by increasing the perimeter weighting of the club head, an increase in the total mass/swing weight of the club head (i.e., the magnitude of the center of gravity) has a strong, negative effect on club head speed and hitting distance. Said another way, to maximize club head speed (and hitting distance), a lower total mass is desired; however a lower total mass generally reduces the club head's moment of inertia (and forgiveness).

The desire for a faster swing speed (i.e., lower mass) and greater forgiveness (i.e., larger MOI or specifically placed COG) presents a difficult optimization problem. These competing constraints explain why most drivers/woods are formed from hollow, thin-walled bodies, with nearly all of the mass being positioned as far from the COG as possible (i.e., to maximize the various MOI's). Additionally, removable/interchangeable weights have been used to alter other dynamic, swing parameters and/or to move the COG. Therefore, the total of all club head mass is the sum of the total amount of structural mass and the total amount of discretionary mass. Typical driver designs generally have a total club head mass of from about 195 g to about 215 g.

Structural mass generally refers to the mass of the materials that are required to provide the club head with the structural resilience needed to withstand repeated impacts. Structural mass is highly design-dependant, and provides a designer with a relatively low amount of control over specific mass distribution.

Discretionary mass is any additional mass (beyond the minimum structural requirements) that may be added to the club head design for the sole purpose of customizing the performance and/or forgiveness of the club. In an ideal club design, for a constant total swing weight, the amount of structural mass would be minimized (without sacrificing resiliency) to provide a designer with additional discretionary mass to customize club performance.

While this provided background description attempts to clearly explain certain club-related terminology, it is meant to be illustrative and not limiting. Custom within the industry, rules set by golf organizations such as the United States Golf Association (USGA) or the R&A, and naming convention may augment this description of terminology without departing from the scope of the present application.

SUMMARY

A golf club head includes a face, a crown, a sole, and defines a bore that is configured to receive and to selectively retain an elongate weight. In one configuration, the bore is aligned on a longitudinal axis that intersects the face, and an elongate weight is insertable into the bore in either a first orientation or a second orientation. In the first orientation, a first end of the weight makes initial entry into the bore, whereas in the second orientation, a second end of the weight makes initial entry into the bore.

In one configuration, the golf club head has a center of gravity that is movable by reversing the weight from the first orientation to the second orientation. For example, reversing the weight may result in a net movement of the center of gravity of the golf club head by more than about 2.0 mm. In one configuration, reversing the weight from the first orientation to the second orientation within the bore results in a net movement of at least 13 grams by a distance of at least 30 mm within the club head.

The above features and advantages and other features and advantages of the present invention are readily apparent from the following detailed description of the best modes for carrying out the invention when taken in connection with the accompanying drawings.

DETAILED DESCRIPTION

Figure 1:
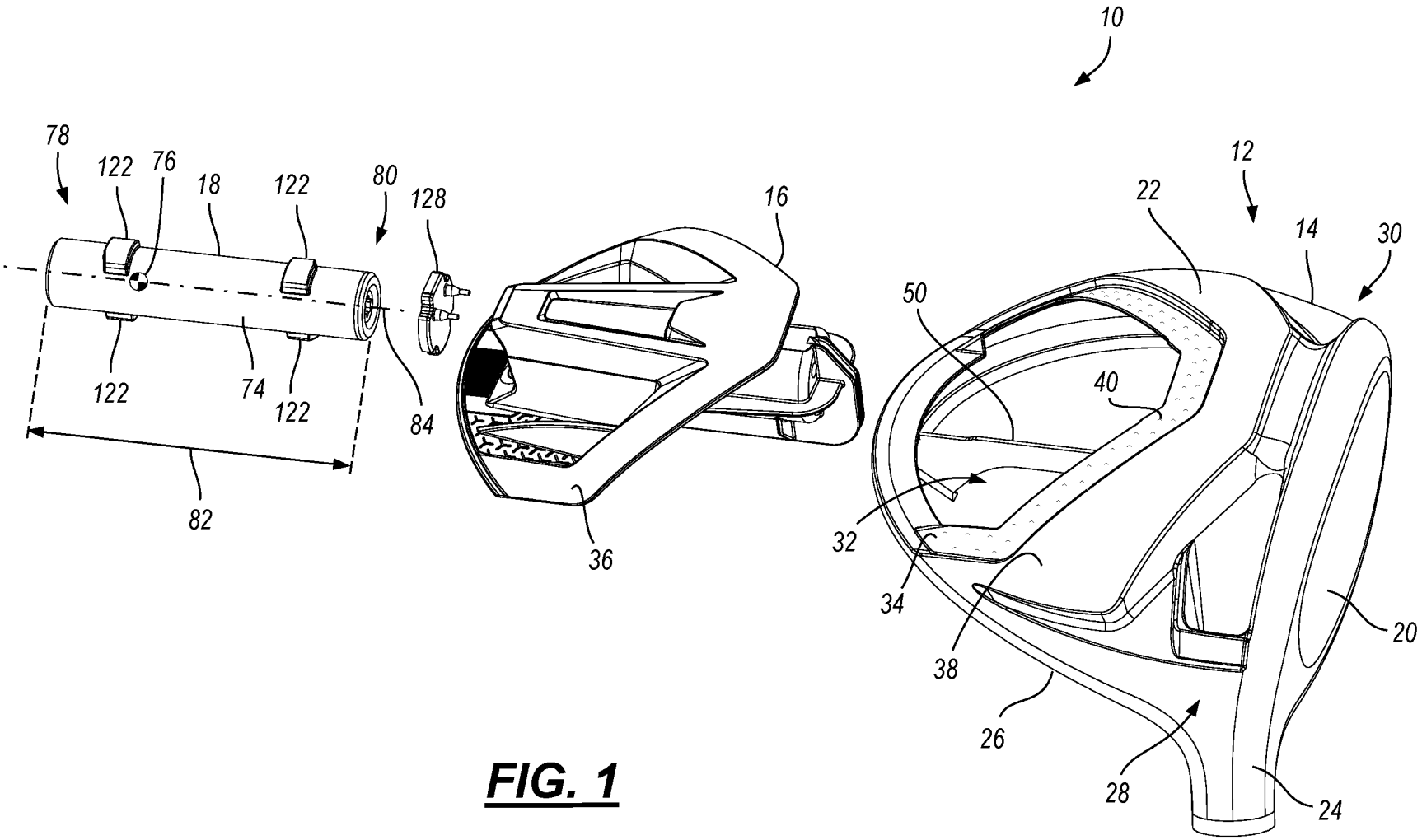
FIG. 1 is a schematic exploded perspective view of a golf club head having a polymeric insert.

Referring to the drawings, wherein like reference numerals are used to identify like or identical components in the various views, FIG. 1 schematically illustrates an exploded perspective view 10 of a golf club head 12. In particular, the present technology relates to the design of a wood-style head, such as a driver, fairway wood, or hybrid iron.

As shown, the golf club head 12 includes a body portion 14 ("body 14") and an insert portion 16 ("insert 16") that may be secured together to define a closed volume. One or more weights 18 may be selectively coupled with the body 14 and/or insert 16 to provide a user with an ability to alter the stock performance of the club head 12.

As shown, the body 12 includes a face 20, a sole 22, a hosel 24, and a crown 26 (i.e., disposed on an opposite side of the club head 12 from the sole 22). A heel portion 28 may generally be defined on a first side of the face 20, and may include the hosel 24. Likewise, a toe portion 30 may generally be defined on an opposite side of the face 20 from the heel portion 28.

The body 12 may be formed through any suitable manufacturing process that may be used to form a substantially hollow body. For example, processes such as stamping, casting, molding, and/or forging may be used to either form the body as a single unitary component, or to form various subcomponents that may subsequently be fused together. In a configuration where the body is formed from a plurality of sub-components, each sub-component may be formed from a light-weight metal alloy, such as, for example, a stainless steel (e.g., AISI type 304 or AISI type 630 stainless steel), a titanium alloy (e.g., a Ti-6Al-4V or Ti-8Al-1Mo-1V Titanium alloy), an amorphous metal alloy, or other similar materials.

Figure 2:
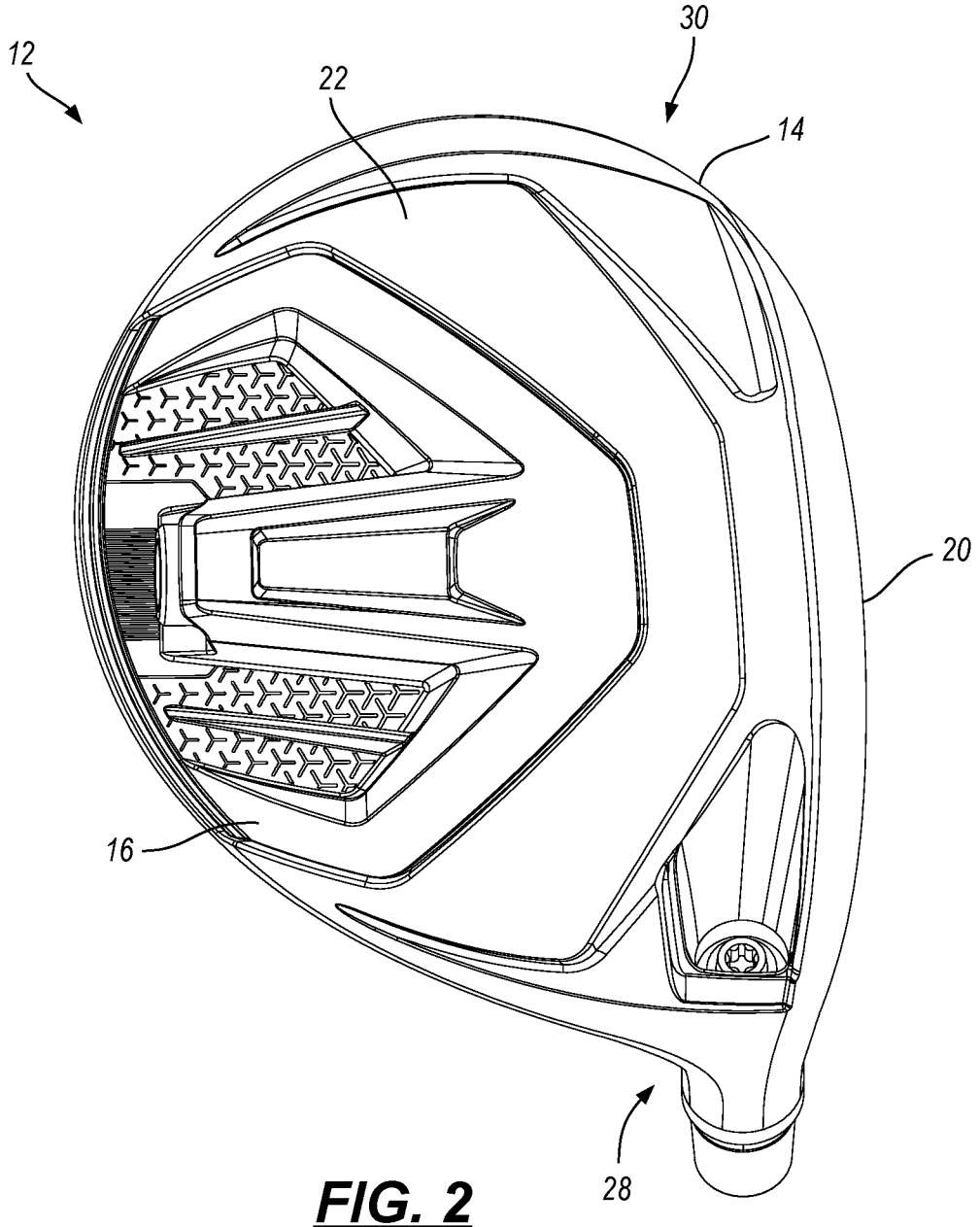
FIG. 2 is a schematic bottom view of the golf club head provided in FIG. 1.

The body 14 may define an opening 32 that is adapted to receive the insert 14. In one configuration, the opening 32 may be provided entirely in the sole 22, however, in other configurations, the opening 32 may also extend to include a portion of the crown 26. As generally shown in FIG. 2, the insert 16 may be secured to the body 14 such that it entirely covers the opening 32.

The insert 16 may be a polymeric component that is affixed to the body 14 in a manner that allows it to withstand repeated shock/impact loadings. In one configuration, the insert 16 may be formed from a polymeric material that includes one or more polyamides, polyimides, polyamide-imides, polyetheretherketones (PEEK), polycarbonates, engineering polyurethanes, and/or other similar materials. In general, the polymeric material may be a either thermoplastic or thermoset, and may be unfilled, filled with a chopped fiber such as a glass fiber or a carbon fiber, or may have other suitable fillers and/or additives to promote increased strength. In one configuration, a suitable material may have a tensile strength of at least about 180 MPa, while in other configurations it may have a tensile strength of at least about 220 MPa. For example, in one configuration, the polymeric material may be an aliphatic polyamide that is filled with a carbon filler material, such as chopped carbon fiber.

By replacing a portion of the body 14 with a comparatively lighter polymeric insert 16, either the entire weight of the club head 12 may be reduced (which may provide faster club head speeds and/or longer hitting distances) or the ratio of discretionary weight to structural weight may be increased (i.e., for a constant club head weight). Additionally, because polymeric molding techniques are generally capable of forming more intricate and/or complex designs than traditional metal forming techniques, the use of a polymeric insert 16 may also provide greater freedom in styling the overall appearance of the club head.

Referring again to FIG. 1, the insert 16 may be affixed to the body 14 of the club head 12 using an adhesive that is selected to bond with both the metal body 14 and the polymer of the insert 16. Such an adhesive may include, for example, a two-part acrylic epoxy such as DP-810, available from the 3M Company of St. Paul, Minn. The adhesive may be disposed between the insert 16 and an outer bond surface 34 of the body 14. The outer bond surface 34 may be at least partially recessed into the body 14 such that when the insert 16 is installed, an outer surface 36 of the insert 16 may either be substantially flush with an outer surface 38 of the sole 22, or may be partially recessed relative to the outer surface 38 of the sole 22.

In one configuration, the bond surface 34 may include a plurality of embossed spacing features 40 disposed in a spaced arrangement across the surface 34. The spacing features 40 may include one or more bumps or ridges that are provided to ensure a uniform, minimum adhesive thickness between the body 14 and the insert 16. In one configuration, each of the plurality of spacing features 40 may protrude above the bond surface 34 by about 0.05 mm to about 0.50 mm.

While most adhesives will readily bond to metals, typical bond strengths to polymers are comparatively lower. Therefore, to improve the adhesive bonding with the insert 16, the insert 16 may be pre-treated prior to assembly. In one configuration, such a pre-treatment may include a corona discharge or plasma discharge surface treatment, which may increase the surface energy of the polymer. In other embodiments, chemical adhesion promoters and/or mechanical abrasion may alternatively be used to increase the bond strength with the polymer.

While providing an opening 32 in the body 14 serves to reduce the weight of the club head 12, it also can negatively affect the structural integrity and/or durability of the club head 12 if not properly reinforced. Any flexure of the body 14 around the opening 32 may, for example, negatively affect the bond strength of the adhesive used to secure the insert 16. To replace some or all of the lost structural rigidity, one or more support struts 50 may extend across the opening 32 to stiffen the body structure.

Figure 3:
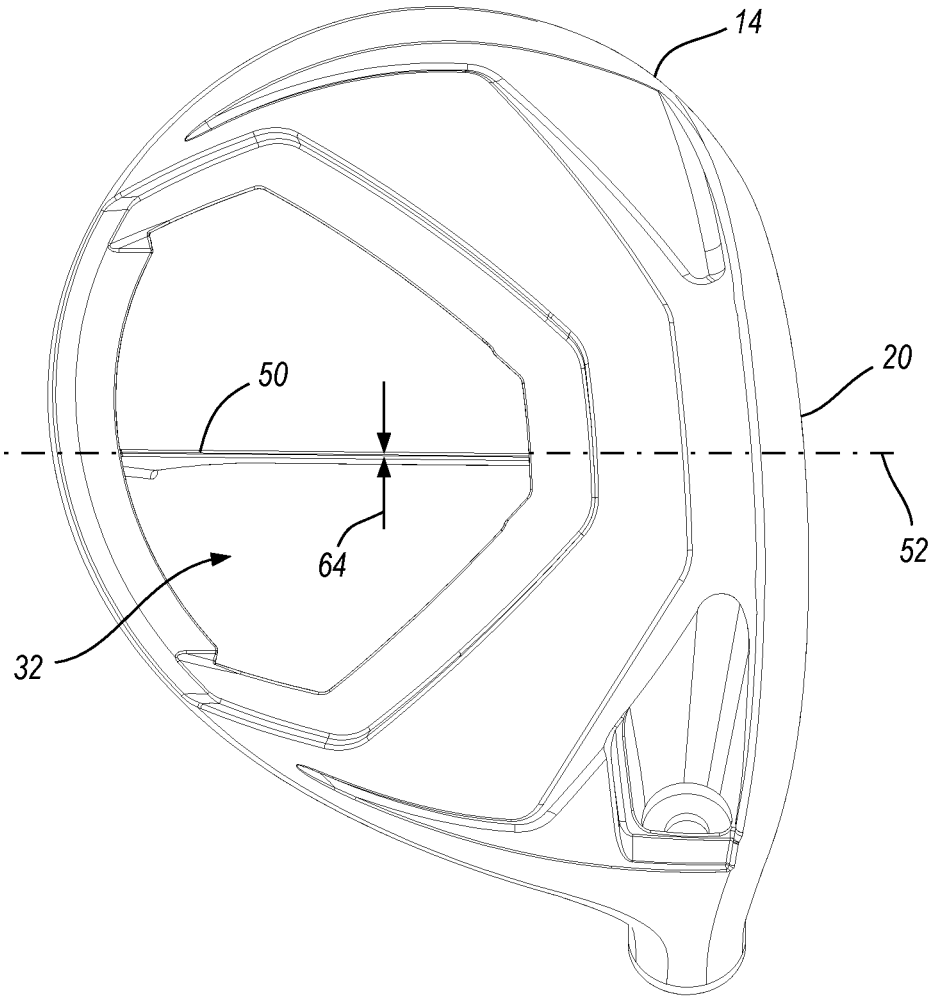
FIG. 3 is a schematic bottom view of a metallic body of a golf club head.

FIG. 3 schematically illustrates a club head body 14 with a single support strut 50 extending across the opening 32. In this configuration, the strut 50 may have a longitudinal axis 52 that intersects the face 20 of the club head 12 (more clearly illustrated in FIG. 5). As used herein, when an axis "intersects" the face, it should be understood that the axis is not constrained to exist only on the described component, but instead extends linearly beyond the component as well.

Figure 4:
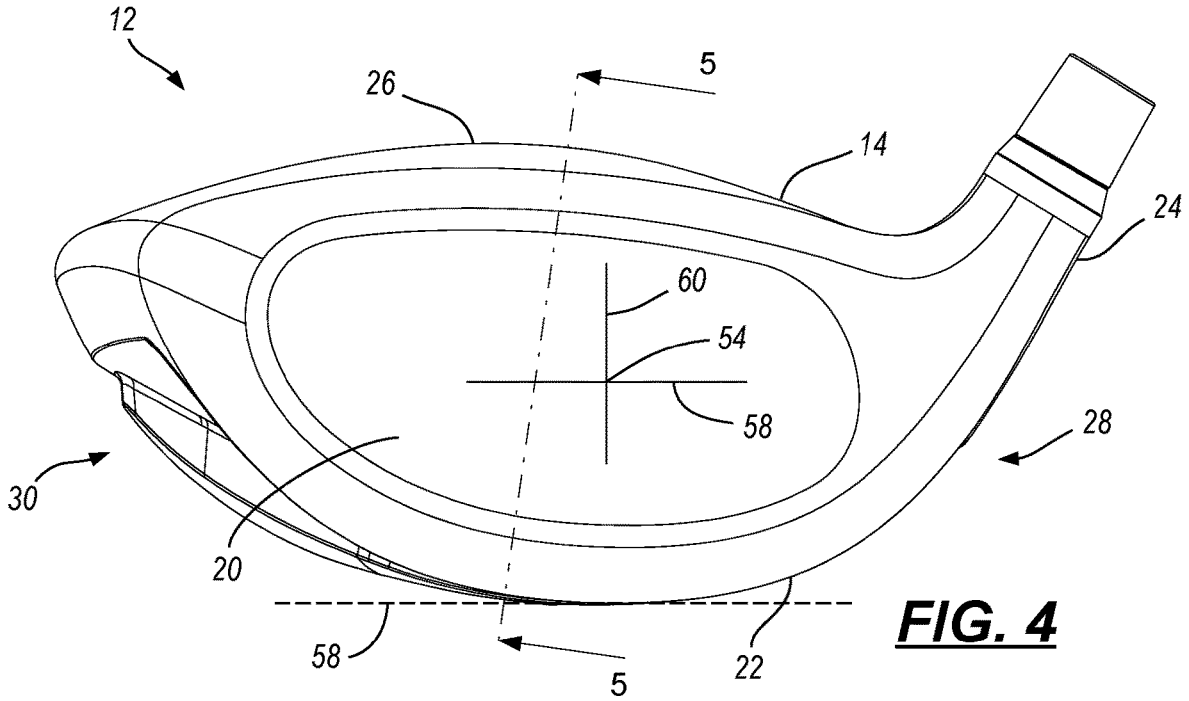
FIG. 4 is a schematic side view of the face of a golf club head.
Figure 5:
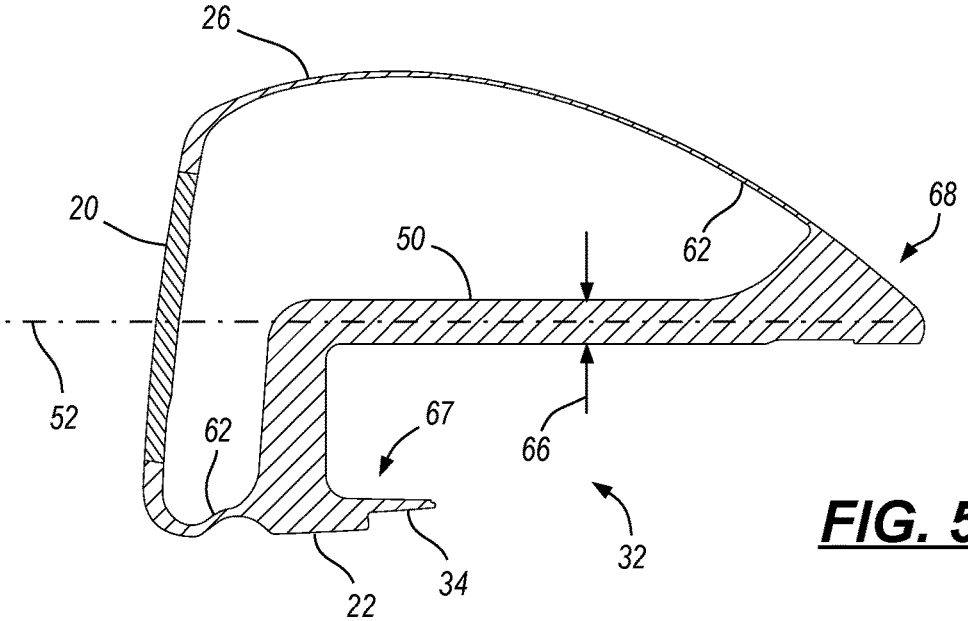
FIG. 5 is a schematic cross-sectional view of the golf club head of FIG. 4, taken along line 5-5.
Figure 6:
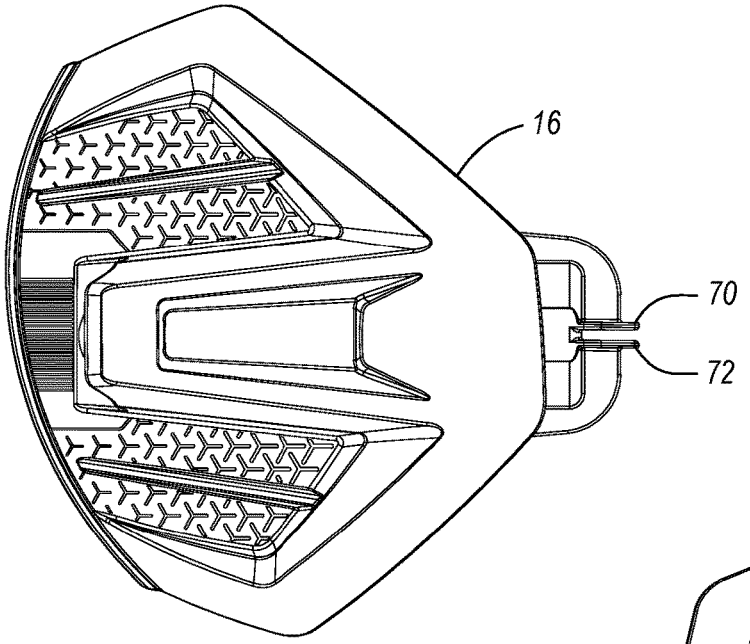
FIG. 6 is a schematic top view of an insert that is configured to be disposed in an opening provided in a body of a golf club head.
Figure 7:
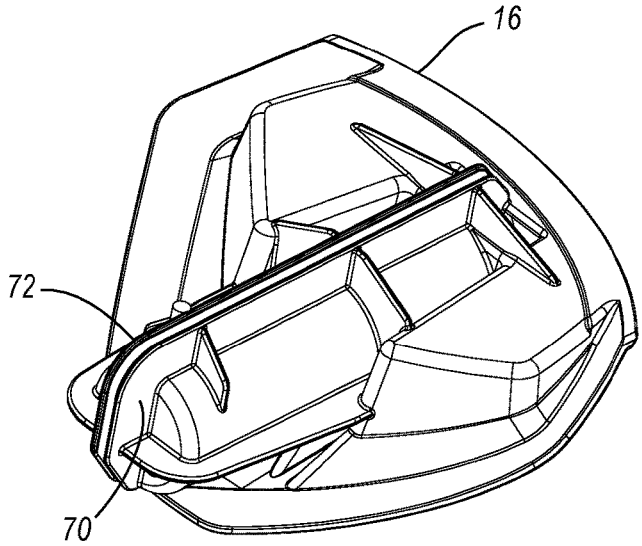
FIG. 7 is a schematic perspective view of the underside of the insert provided in FIG. 6.
Figure 8:
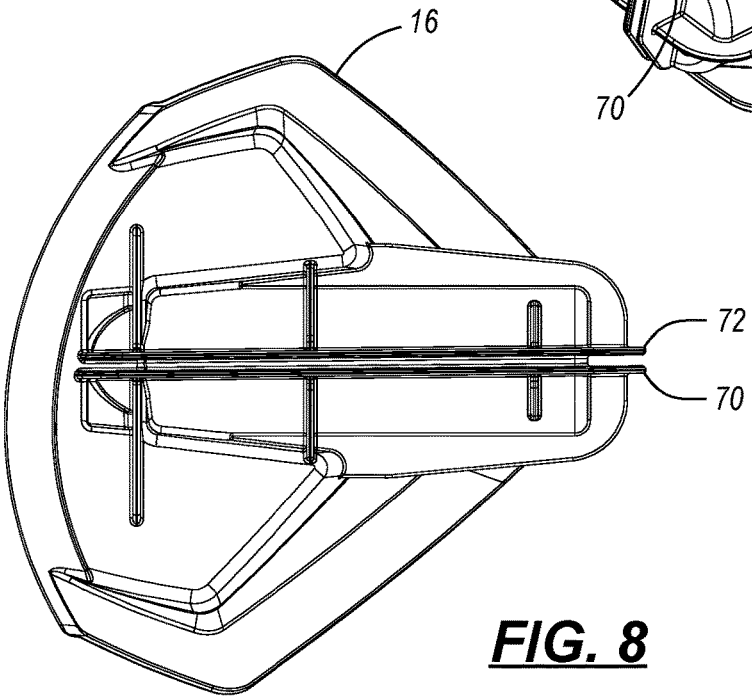
FIG. 8 is a schematic bottom view of the insert provided in FIG. 6.

FIG. 4 provides a face-view of the club head 12 provided in FIG. 3, with a bisecting strut-section taken along line 5-5, which is illustrated as FIG. 5. As shown in FIG. 4, the strut 50 may be offset relative to a face center 54, and may further be angled relative to a vertical plane (i.e., a plane that is perpendicular to the ground plane 56) extending through the face center 54. In one configuration, the offset may be from about 0 mm to about 20 mm. Additionally, the angle formed between the strut 50 and the vertical plane may be from about 0 degrees to about 10 degrees.

The face center 54 is determined using Unites States Golf Association (USGA) standard measuring procedures and methods. In general, the face center 54 is found at the intersection of a first line 58 that bisects the face 20 into equal upper and lower halves, and a second line 60 that bisects the face 20 into equal heel and toe halves. The first line 58 is parallel to the ground plane 56, and the second line 60 is perpendicular to the first line 58. In general, each line is properly placed where the maximum distance between a face edge and the line is equal on both sides of the respective line.

Referring to FIG. 5, the strut 50 may be welded (or otherwise integrally affixed) to an inner surface 62 of the body 14 on opposing sides of the opening 32. In one configuration the strut 50 may be formed from a metal sheet having a thickness 64 of from about 0.5 mm to about 1.5 mm (shown in FIG. 3), and a height 66 of from about 4 mm to about 25 mm. As generally shown in FIG. 5, while the strut 50 may be secured to the inner surface 62 of the sole 22 at a first end 67, in one embodiment it may be secured to the crown 26 at the opposing end 68 or at various places along its length.

In addition to stiffening the body structure, the support strut 50 may also assist in securing the insert 16 to the body 14. As shown in FIGS. 6-8 and 10-11, one embodiment of the insert 16 may include two, protruding walls 70, 72 that are spaced apart from each other by a distance of from about 1.0 mm to about 2.0 mm and are configured to extend onto opposing sides of the strut 50 when the insert 16 is brought into contact with the bond surface 34. The inward-facing surfaces of these walls 70, 72 may be adhered to the strut 50 using, for example, the same adhesive that is used to secure the insert 16 to the outer bond surface 34. By adhering the insert 16 to both the strut 50 and the outer bond surface 34 of the body 14, the total surface area that is bonded between the insert 16 and the body 14 may be increased by more than about 30% above the outer bond surface 34, alone. Additionally, securing the insert 16 in this manner utilizes both the sheer strength of the adhesive (via the strut 50) and the tensile/peel strength of the adhesive (via the bond surface 34).

In one configuration, the ratio of the area of the opening 32 (i.e., the minimum area of a skinned surface disposed across the void that forms the opening 32) to the sheer-bond surface area (i.e., the total bonded surface area between the insert 16 and the strut 50) may be from about 4:1 to about 5.5:1. In a configuration where two support struts are used, the ratio of the area of the opening 32 to the sheer-bond surface area (including bonding to both struts) may be from about 2:1 to about 2.8:1. Additionally, the ratio of the area of the opening 32 to the bonded surface area between the insert 16 and the bond surface 34 (i.e., the tensile-bond surface area) may be from about 2.5:1 to about 4:1. Finally, for a single strut design, the ratio of the area of the opening 32 to the total bonded surface area may be from about 1.5:1 to about 2.5:1. For example, and without limitation, in one configuration, the size of the opening 32 may be about 5000 $mm^2$, the tensile-bond surface area may be about 1500 $mm^2$, and the sheer-bond surface area may be about 1050 $mm^2$. In another configuration, the size of the opening 32 may be at least 3000 $mm^2$, with the bonded surface areas determined according to the above-disclosed ratios.

In one configuration, the insert 16 may have a mass of, for example, from about 20 g to about 25 g, or even from about 15 g to about 30 g. In this manner, the ratio of the mass of the body 14 to the mass of the insert 16 may be, for example, from about 6.5:1 to about 7.5:1, or from about 6:1 to about 8.5:1. In an embodiment where discretionary weights are capable of being selectively secured to the golf club head 12, the combined mass of the body 14 and the mass of the insert 16 (without the mass of any discretionary weights) may be from about 170 g to about 190 g.

As mentioned above, one or more weights 18 may be selectively coupled with the body 14 and/or insert 16 to provide a user with an ability to alter the stock performance of the club head 12. As generally shown in FIG. 1, the weight 18 may generally include an elongate member 74 that may be secured within the golf club head 12. The weight 18 may be unbalanced such that the balance point/center of gravity 76 of the weight 18 may be closer to a first end 78 of the weight 18 than to a second end 80 of the weight 18.

For example, in one configuration, the center of gravity 76 may be spaced from the first end 78 by a distance that is from about 15% to about 30% of the total length 82 of the weight 18, measured along a longitudinal axis 84. In one embodiment, the length 82 of the weight 18 may be, for example, from about 60 to about 75 mm, or even from about 55 mm to about 80 mm.

Figure 12:
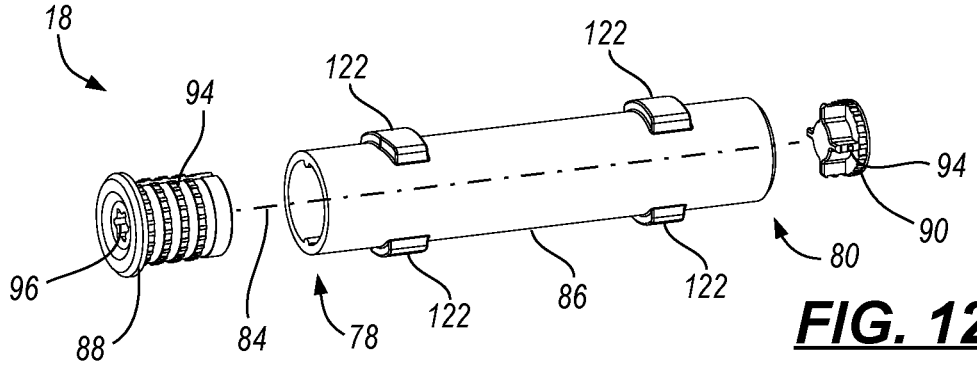
FIG. 12 is a schematic exploded perspective view of a weight that is configured to be selectively disposed in a golf club head.

As generally illustrated in FIG. 12, in one configuration, the weight 18 may generally include a body 86, having a first mass 88 disposed within or proximate to the first end 78 and a second mass 90 disposed within or proximate to a second end 80. In one embodiment, the body 86 may be cylindrical. Each mass 88, 90 may be generally disposed on the longitudinal axis 84 and on an opposing side of the body 86. In such an embodiment, the unbalanced nature may be caused by the first mass 88 being greater than the second mass 90. For example, in one configuration, the first mass 84 may be from about 8.0 grams to about 12.0 grams, while the second mass 88 may be from about 0.4 grams to about 1.2 grams. In other configurations, instead of discrete masses, the weight 18 may be formed from one or more material compositions having varying densities or strategically placed voids to create a weight profile along the longitudinal axis 84 as desired.

In the embodiment shown, each mass 88, 90 may either be molded in place within the body 86, or may be assembled within the body 86 via a press-fit attachment and/or through the use of an adhesive. For example, as shown in FIG. 12, to facilitate a firm press-fit attachment, one or both masses 88, 90 may include a plurality of retention features 94 that may impress into the body 86 upon assembly. The plurality of retention features may include one or more barbs, ridges, or knurling that may extend in a radially outward direction from the respective mass. Additionally, one or both of the masses 88, 90 may include a suitable recess 96 that is shaped and dimensioned to receive a tool or wrench such that the tool or wrench can transfer a torque to the weight 18.

In one configuration, the total mass of the weight 18 may be, for example, from about 13 g to about 17 g, or even from about 10 g to about 20 g. The ratio of the mass of the head 12 (i.e., body 14 plus insert 16) to the mass of the weight 18 may be from about 10:1 to about 12:1, where the ratio of mass of the body 14 to the mass of the weight 18 may be from about 9:1 to about 11:1, and the ratio of the mass of the insert 16 to the mass of the weight 18 may be from about 1:1 to about 2:1. For example, and without limitation, in one embodiment, the body 14 may have a mass of about 154 g, the insert 16 may have a mass of about 22.5 g, and the weight 18 may have a mass of about 15.5 g.

Figure 9:
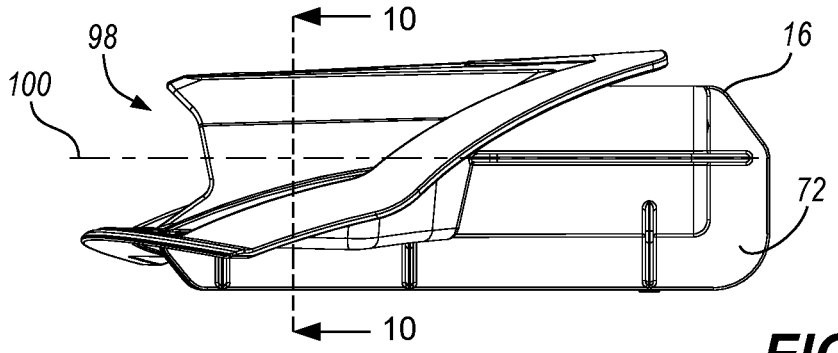
FIG. 9 is a schematic side view of the insert provided in FIG. 6.
Figure 10:
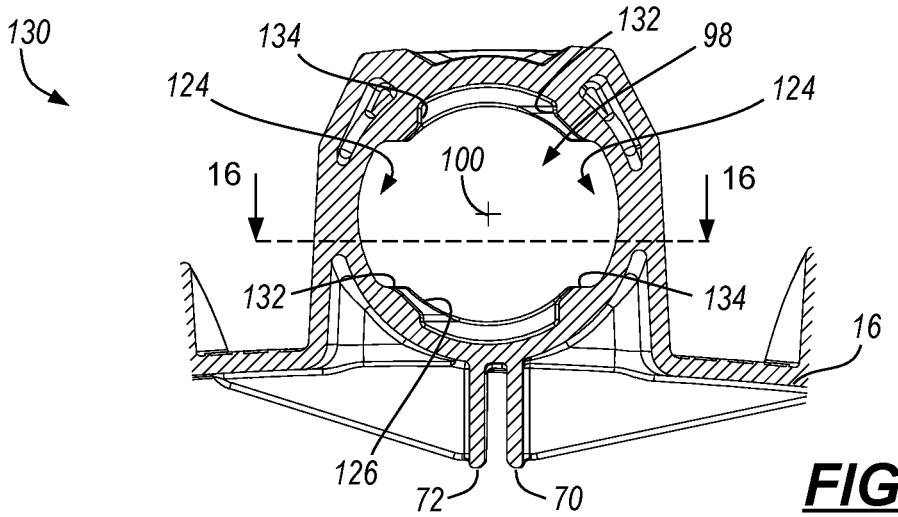
FIG. 10 is a schematic partial cross-sectional view of the insert provided in FIG. 9, taken along line 10-10.
Figure 11:
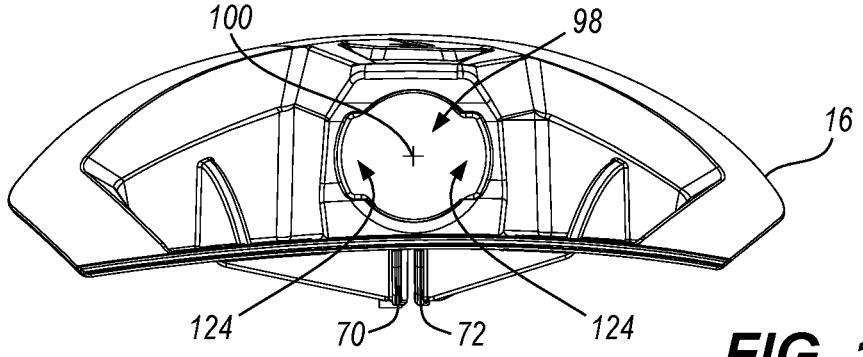
FIG. 11 is a schematic side view of the insert provided in FIG. 6.
Figure 13:
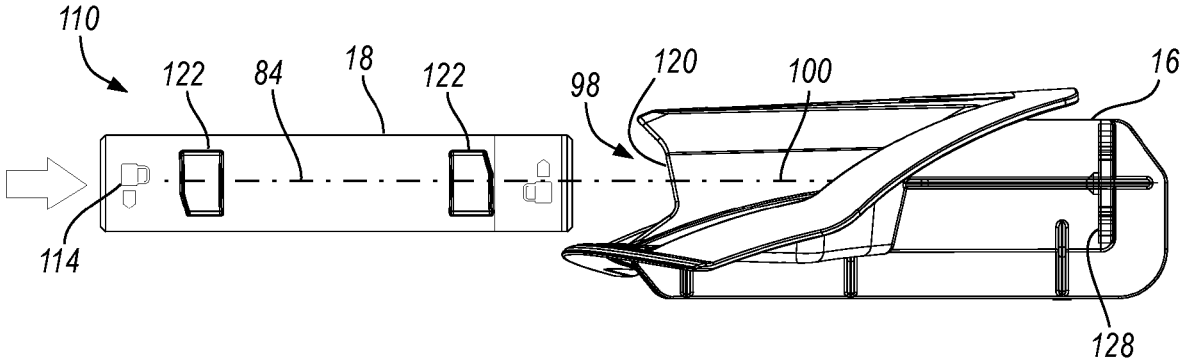
FIG. 13 is a schematic side view of a weight being inserted in a bore defined by an insert of a golf club head.

Referring to FIGS. 9-11, in one configuration, the insert 16 may define an internal bore 98 or recess that is configured to receive and selectively retain the weight 18. The bore 98 may have a longitudinal axis 100, along which the weight 18 may slide while being inserted. The longitudinal axis 100 of the bore 98 may intersect the face 20 if extrapolated beyond the insert 16. As generally shown in FIG. 13, the longitudinal axis 84 of the weight 18 may be coincident with the longitudinal axis 100 of the bore 98 when the weight 18 is inserted into the bore 98.

The weight 18 may be reversible such that it may be inserted into the bore 98 in either a first orientation or in a second orientation. In the first orientation, the first end 78 of the weight 18 may make initial entry into the bore 98 and may be more proximate to the face 20 than is the second end 80. In the second orientation, the second end 80 of the weight 18 may make initial entry into the bore 98 and may be more proximate to the face 20 than is the first end 78.

Reversing the orientation of the weight 18 within the club head 12, may have the effect of moving the COG of the club head 12 between a first location (corresponding to the first orientation) and a second location (corresponding to the second orientation). Due to the orientation of the bore 98, the motion of the COG between the first location and the second location would be along a line that, if extrapolated, would intersect the face 20 of the club head 12. In one configuration, the net movement of the COG of the club head 12 that is caused by reversing the weight 18 is greater than about 2.0 mm. In another embodiment, the net movement of the COG caused by reversing the weight 18 is greater than about 2.5 mm. Additionally, reversing the weight 18 may, for example, cause a net movement of the COG 76 of the weight 18 within the club head 12 of from about 30 mm to about 35 mm, or even from about 25 mm to about 50 mm. Said another way, reversing the weight 18 may cause a net movement of at least 13 grams of mass by a distance of at least 30 mm. For example, and without limitation, in one configuration, the COG of the weight 18 may be located about 25% in from the first end 78, and reversing the weight 18 within the bore 98 may have the net effect of moving 15.5 g of mass by a total distance of about 32 mm. Additionally, reversing the weight 18 within the club head 12 may also cause the COG of the weight 18 to move between a first location and a second location that, if connected, would be along a line that would intersect the face 20 of the club head 12.

In general, placing the COG of the club head 12 further away from the face 20 provides a greater dynamic loft angle than if the COG is closer to the face 20. Additionally, placing the COG further away from the face 20 will typically provide more of a draw-bias than if the COG is closer to the face 20 (which would comparatively provide more of a fade-bias). Therefore, by reversing the weight 18, a user may fine-tune the playing characteristics of the club head 12 to suit his/her particular interests and tendencies.

Figure 14:
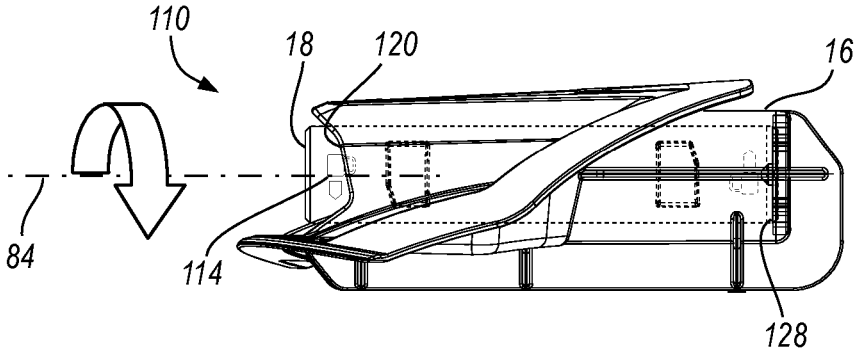
FIG. 14 is a schematic side view of a weight disposed in a first angular orientation within a bore of an insert.
Figure 15:
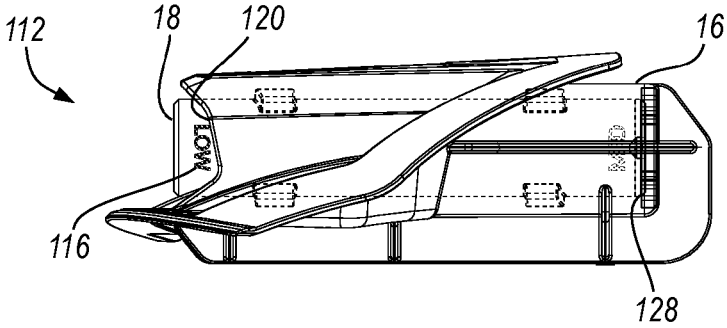
FIG. 15 is a side view of a weight disposed in a second angular orientation within a bore of an insert.
Figure 16:
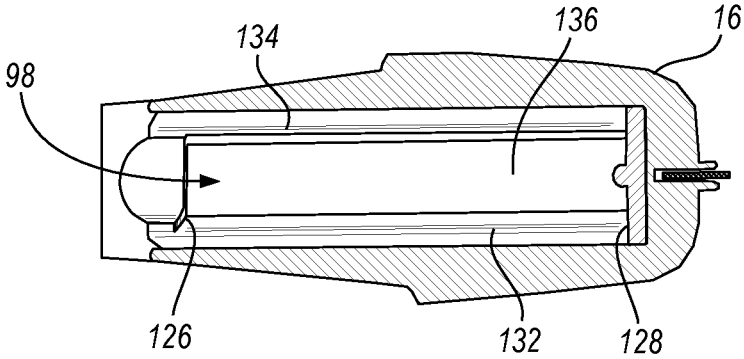
FIG. 16 is a schematic partial cross-sectional view of the insert of FIG. 10, taken along line 16-16.

Referring to FIGS. 13-15, once the weight 18 is inserted into the bore 98, as shown in FIG. 13, the weight 18 may be selectively secured into the club head 12 by rotating the weight 18 about its longitudinal axis 84 between a first angular position 110 (shown in FIG. 14) and a second angular position 112 (shown in FIG. 15) within the bore 98. In the first angular position 110, the weight 18 may be "unlocked" such that it may be free to be withdrawn from the bore 98. In the second angular position 112, the weight 18 may be "locked" such that it is selectively restrained within the bore 98.

In one configuration, the first angular position 110 and the second angular position 112 may be about 90 degrees to about 180 degrees apart from each other. In this manner, rotation of the weight 18 through about ¼ turn to about ½ turn may be all that is required to secure the weight 18 in place. In other embodiments, the first angular position 110 and second angular position 112 may be separated by an angular rotation of from about 90 degrees to about 270 degrees. In still other embodiments, the first angular position 110 and second angular position 112 may be separated by an angular rotation of more than about 270 degrees (e.g., such as a screw-style connection).

Referring to FIG. 14, when the weight 18 is fully inserted into the bore 98 and disposed in the first angular position 110, a first indicia 114 may be outwardly visible to a user. Conversely, after the weight 18 is rotated to the second angular position 112, the first indicia 114 may be hidden from view, and a second indicia 116 may be outwardly visible to the user. In one configuration, each of the first and second indicia 114, 116 may be respectively positioned on a different portion of a common circumference of the weight 18. The first indicia 114 and the second indicia 116 may each represent a different state of configuration for the weight 18. For example, the first indicia 114 may represent an unlocked state and the second indicia 116 may represent a locked state. Alternatively, if the weight is not symmetrically balanced about the longitudinal axis 84, the first indicia 114 may represent a first weight configuration (e.g., in a vertical plane) while the second indicia 116 may represent a second weight configuration.

In an embodiment where at least one of the first and second indicia 114, 116 represents an "unlocked" and/or "locked" state, the respective indicia may include a textual or graphical indicator, or alternatively a color indicator such as red or green. For example, as shown in FIG. 14, the first indicia 114 may include a graphic of a lock, together with a directional arrow that informs the user about which way to rotate the weight 18 to lock it in place. Once locked, the lock prompt may be hidden from view, and the user may then see the second indicia that provides information about how the club is configured and/or how the weight is oriented (i.e., "low" loft).

Transitioning between the first angular position 110 and the second angular position 112 may result in one of the first indicia 114 and the second indicia 116 being obfuscated or hidden by a portion of the insert 16. At the same time, the remaining indicia may then become visible through a viewing window or port provided in the insert. In one configuration, the viewing window may be a hole defined by the insert. In another configuration, as shown in FIGS. 13-14, the viewing window may be a recessed edge 120 of the bore 98, where a portion of the weight 18 extends proud of the recessed edge and one respective indicia is visible only adjacent to the recessed edge 120.

In one configuration, the weight 18 may be transitioned between the first and the second angular positions 110, 112 under the assistance or urging of a tool. As mentioned above, the tool may be configured to fit within the recess 96 provided in the weight 18 and to transmit a torque to the weight 18. The tool may be, for example, a star or hex wrench having a suitable handle for a user to grip and apply torque. In one configuration, the tool may be a torque-limited device that is capable of allowing a user to apply a force only up to a predetermined amount.

FIGS. 10-16 illustrate one design of a locking mechanism that may be used to secure the weight 18 within the bore 98 by rotating it from the first angular position 110 to the second angular position 112. Referring to FIGS. 12 and 13, the weight 18 may include one or more radial protrusions 122 that extend outward from the elongate body 86. In another embodiment, the weight 18 may include two or more, or four or more radial protrusions 122 extending from the body 86, which may be equally spaced about the circumference. When inserted into the bore 98, the protrusions 122 may each freely slide in a longitudinal direction down a respective channel 124 provided in the bore 98 (shown in FIGS. 10-11). Once the weight 18 is fully inserted in the bore 98, a subsequent rotation of the weight 18 then causes at least one of the protrusions 122 to contact a cinching ramp 126, which extends into the bore 98 (shown in FIG. 10 and in the partial cross-sectional view provided in FIG. 16). The cinching ramp 126 includes a sloped portion that, as the respective protrusion 122 slides against it, exerts a longitudinally directed force against the weight 18/protrusion 122, and causes the weight to be drawn into the bore 98/toward the face 20.

In one configuration, a dampening member 128 may be disposed at the end of the bore 98 that is opposite from threshold/opening of the bore 98. The dampening member 128 may include, for example, a deformable material that is elastically compressed when the weight 18 is drawn into the bore 98 via the cinching ramp 126. In one configuration, the dampening member 128 may include a gasket formed from a rubber or thermoplastic polyurethane material. In one embodiment, the gasket may have a hardness, measured on the Shore-A scale of from about 70 A to about 90 A. In another embodiment, the gasket may have a hardness, measured on the Shore-A scale of from about 80 A to about 90 A.

Once fully rotated into the second, locked angular position 112, the cinching ramp 126 may prevent the weight 18 from being directly removed from the bore 98 via its contact with the protrusion 122. The dampening member 128 is intended to firmly secure the weight 18 along a longitudinal direction by applying an elastic biasing force/pressure to the weight. Preventing relative movement between the weight 18 and the head 12 is important to prevent and/or greatly reduce any secondary impact forces that may be imparted by the weight 18 during a swing. To accomplish this, the dampening member 128 may be slightly thicker (along a longitudinal dimension of the bore) than a predefined tolerance between an end of the weight 18 and an end of the bore 98 when the protrusion 122 is in firm contact with the cinching ramp 126. More specifically, as the weight 18 is rotated into the second, locked angular position 112, the contact between the protrusion 122 and the cinching ramp 126 may cause the weight 18 to impinge into the dampening member 128. This impingement is preferably an elastic deformation/compression of the dampening member that results in a compressive spring force being applied to the weight 18. In one configuration, for a dampening member 128 having a hardness measured on the Shore A scale of 85 A, the various components may be dimensioned such that, when in a locked position, the weight 18 compresses the dampening member 128 by about 0.4 mm to about 1.0 mm, or alternatively, by about 15% to about 45% of an original thickness of the dampening member 128. If a material having a different hardness is used for the dampening member 128, the amount of compression may be adjusted to provide comparable biasing forces to what is disclosed herein.

To ensure that the weight 18 remains as positioned by the user, in one configuration, one or more rotational locking features may be provided that are adapted to restrain any rotational motion caused by a torque that is below a predetermined torque threshold. Referring to the cross-sectional view 130 provided in FIG. 10, one embodiment of such a rotational locking feature includes at least two stops 132, 134 that extend radially inward from an outer cylindrical portion 136 of the bore 98. These stops 132, 134 are positioned such that they are aligned with the rotational path of the protrusion 122 between the first and second angular positions 110, 112.

Under applied torque loads that are less than some predetermined torque, either of the stops 132, 134 may inhibit the rotation of the weight 18 by interfering with the angular motion of a corresponding protrusion 122. A larger torque load (i.e., over the predetermined torque) that is applied to the weight 18, however, may cause the insert 16 to elastically yield in an area that is proximate to the first stop 132 (i.e., in a manner similar to a compliant mechanism). By elastically yielding, the stop 132 may retract under the urging of the protrusion 122 and allow the protrusion 122 to pass, after which, it may return to its previous position. In one configuration, the predetermined torque is between about 10 inch-pounds and about 30 inch-pounds. For example, in one specific configuration, the predetermined torque may be about 20 inch-pounds. The predetermined torque may ultimately be a function of the resistance provided by the stop 132, along with the force required to compress the dampening member 128, and any frictional drag forces that may be present. In this manner, the first stop 132 may inhibit rotation only up to the predetermined torque (applied to the weight), and may compliantly retract from the path of the protrusion under larger applied torques. In one configuration, the geometry of the stop may be designed such that an applied torque above a first threshold is required to transition the weight into a locked state from an unlocked state, and a torque above a second threshold is required to transition the weight into an unlocked state from a locked state. In one configuration, the second threshold is greater than the first threshold, though each may be between about 10 inch-pounds and about 40 inch-pounds, or even between about 25 inch-pounds and about 40 inch-pounds. For example, in one configuration, the first threshold is about 30 inch-pounds, and the second threshold is about 36 inch-pounds.

While the insert 16 may be compliant in/around the first stop 132, in one configuration, the second stop 134 may be more rigid. For example, in one configuration, such as shown in FIG. 10, the second stop 134 may protrude a greater distance toward the center of the bore 98 than the first stop 132. In one configuration, the radial interference between the protrusion 122 and the first stop 132 may be about 0.5 mm, while the radial interference between the protrusion 122 and the second stop 134 may be about 1.0 mm. In addition to having differing interference heights (or alternatively), less compliance or no compliance may be designed into the insert 16 proximate to the second stop 134 to provide a more rigid stop.

While various embodiments have been described, the description is intended to be exemplary, rather than limiting and it will be apparent to those of ordinary skill in the art that many more embodiments and implementations are possible. Accordingly, the invention is not to be restricted except in light of the attached claims and their equivalents. Also, various modifications and changes may be made within the scope of the attached claims.

"A," "an," "the," "at least one," and "one or more" are used interchangeably to indicate that at least one of the item is present; a plurality of such items may be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters. In addition, disclosure of ranges includes disclosure of all values and further divided ranges within the entire range. Each value within a range and the endpoints of a range are hereby all disclosed as separate embodiment. The terms "comprises," "comprising," "including," and "having," are inclusive and therefore specify the presence of stated items, but do not preclude the presence of other items. As used in this specification, the term "or" includes any and all combinations of one or more of the listed items. When the terms first, second, third, etc. are used to differentiate various items from each other, these designations are merely for convenience and do not limit the items.

The invention claimed is:

1. A golf club comprising:

a golf club head including a metal portion adhered to a polymeric portion to define a closed internal volume therebetween, the golf club head having a face, a crown, and a sole;

wherein:

the metal portion comprises a first bond surface and the polymeric portion comprises a second bond surface, which overlaps with the first bond surface to define a lap joint therebetween;

wherein:

the metal portion comprises a bond promoting feature and is operative to increase the bond strength between the metal portion and the polymeric portion;

the polymeric portion defines a bore extending between a first closed end and a second open end, the bore having a longitudinal axis extending between the first end and the second end, and wherein the bore is aligned such that the longitudinal axis of the bore intersects the face and wherein the bore is configured to receive an elongate weight via the open end and is further configured to selectively retain the elongate weight within the bore;

wherein:

the polymeric portion includes a polymeric wall extending within the closed internal volume and transversely outward from a sidewall defining the bore; and wherein:

the polymeric wall is adhered, via an adhesive, to the metal portion of the golf club head and is operative to both reinforce the sidewall and to transfer impact stresses from the sidewall to the metal portion of the golf club head.

2. The golf club head of claim 1, wherein the first bond surface and the second bond surface are adhered via a two-part acrylic epoxy.

3. The golf club head of claim 1, wherein the bond promoting feature comprises a plurality of spacing features that protrude vertically from the first bond surface.

4. The golf club head of claim 3, wherein the vertically protruding spacing features comprise bumps or ridges and are operative to minimize an adhesive thickness between the first bond surface and the second bond surface.

5. The golf club head of claim 3, wherein the protrusions comprise a height from about 0.05 mm to about 0.50 mm.

6. The golf club head of claim 1, wherein the first bond surface is partially recessed into the body.

7. The golf club head of claim 1, wherein the second bond surface comprises chemical adhesion promoters.

8. The golf club head of claim 1, wherein the elongate weight comprises a first mass and a second mass disposed on opposite ends of the elongate weight.

9. The golf club head of claim 7, wherein the first mass is greater than the second mass.

10. The golf club head of claim 5, wherein the polymeric portion is substantially flush with the sole.

11. A method of providing a golf club head, the method comprising:

providing a metal portion of the golf club head comprising a first bond surface;

providing a polymeric portion of the golf club head comprising a second bond surface;

coupling the first bond surface and the second bond surface;

wherein:

providing the first bond surface comprises applying a bond promoting feature to increase the bond strength between the metal portion and polymeric portion;

providing the polymeric portion defines a bore extending between a first closed end and a second open end, the bore having a longitudinal axis extending between the first and the second end, and wherein the bore is aligned such that the longitudinal axis of the bore intersects the face and wherein the bore is configured to receive an elongate weight via the open end and is further configured to selectively retain the elongate weight within the bore;

coupling the first bond surface and the second bond surface defines a closed internal volume of the club head; and providing the polymeric portion comprises providing a polymeric wall extending within the closed internal volume and transversely outward from a sidewall defining the bore, and disposing an adhesive between the polymeric wall and the metal portion of the golf club head which is operative to both reinforce the sidewall and to transfer impact stresses from the sidewall to the metal portion of the golf club head.

12. The method of claim 11, wherein providing the bond promoting feature is selected from the group consisting of:

treating the first bond surface with plasma discharge;

treating the first bond surface with chemical adhesion promotors;

abrading the first bond surface mechanically; and providing a plurality of spacing features protruding above the first bond surface.

13. A golf club comprising:

a golf club head including a metal portion adhered to a polymeric portion to define a closed internal volume therebetween, the golf club head having a face, a crown, and a sole;

wherein:

the metal portion comprises a first bond surface and the polymeric portion comprises a second bond surface, which overlaps with the first bond surface to define a lap joint therebetween;

wherein:

the metal portion comprises a bond promoting feature and is operative to increase the bond strength between the metal portion and the polymeric portion;

the polymeric portion defines a bore extending between a first closed end and a second open end, the bore having a longitudinal axis extending between the first end and the second end, and wherein the bore is aligned such that the longitudinal axis of the bore intersects the face and wherein the bore is configured to receive an elongate weight via the open end and is further configured to selectively retain the elongate weight within the bore;

wherein:

the elongate weight comprises a first mass disposed on the first end and a second mass disposed on the second end;

the polymeric portion includes a polymeric wall extending within the closed internal volume and transversely outward from a sidewall defining the bore; and the polymeric wall is adhered, via an adhesive, to the metal portion of the golf club head and is operative to both reinforce the sidewall and to transfer impact stresses from the sidewall to the metal portion of the golf club head.

14. The golf club head of claim 13, wherein the first mass of the elongate weight and the second mass of the elongate weight comprise a plurality of retention features extending radially outward from the first mass and the second mass.

15. The golf club head of claim 13, wherein the first mass and the second mass are disposed on the elongate weight via an adhesive.

16. The golf clubhead of claim 13, wherein the first mass and the second mass comprise a recess configured to receive a turning tool to transfer a torque to the weight.

17. The golf club head of claim 13, wherein the first mass is from about 8.0 g to about 12.0 g; and wherein the second mass is from about 0.4 g to about 1.2 g.

18. The golf club head of claim 17, wherein the elongate weight comprises a total mass from 10 g to 20 g.

19. The golf clubhead of claim 13, wherein the elongate weight is rotatable about its longitudinal axis from a first weight configuration to a second weight configuration.

20. The golf club head of claim 19, wherein rotating the elongate weight from the first configuration to the second configuration within the bore results in a net movement of at least 13 g by a distance of at least 30 mm within the club head.

* * * * *